US011821162B2

(12) United States Patent
Kassen et al.

(10) Patent No.: US 11,821,162 B2
(45) Date of Patent: Nov. 21, 2023

(54) SYSTEM AND METHOD FOR ADAPTIVE CALIBRATION OF BLADE POSITION CONTROL ON SELF-PROPELLED WORK VEHICLES

(71) Applicant: Deere & Company, Moline, IL (US)

(72) Inventors: Daniel M. Kassen, Hazel Green, WI (US); Todd F. Velde, Dubuque, IA (US)

(73) Assignee: Deere & Company, Moline, IL (US)

( * ) Notice: Subject to any disclaimer, the term of this patent is extended or adjusted under 35 U.S.C. 154(b) by 455 days.

(21) Appl. No.: 17/162,366

(22) Filed: Jan. 29, 2021

(65) Prior Publication Data

US 2022/0243422 A1 Aug. 4, 2022

(51) Int. Cl.

| | |
|---|---|
| ***E02F 9/26*** | (2006.01) |
| ***E02F 3/84*** | (2006.01) |
| *E02F 9/22* | (2006.01) |
| *E02F 3/76* | (2006.01) |

(52) U.S. Cl.

CPC ..... *E02F 3/844* (2013.01); *E02F 9/262* (2013.01); *E02F 9/265* (2013.01); *E02F 3/7609* (2013.01); *E02F 9/2203* (2013.01); *E02F 9/2228* (2013.01); *E02F 9/2285* (2013.01); *E02F 9/2296* (2013.01)

(58) Field of Classification Search

CPC ..... E02F 3/7609; E02F 3/844; E02F 9/205; E02F 9/2203; E02F 9/2228; E02F 9/262; E02F 9/265

See application file for complete search history.

(56) References Cited

U.S. PATENT DOCUMENTS

| | | | | |
|---|---|---|---|---|
| 8,141,650 | B2 | 3/2012 | Breiner et al. | |
| 8,634,991 | B2 | 1/2014 | Douglas | |
| 8,919,455 | B2 | 12/2014 | Hendron et al. | |
| 8,924,096 | B2 * | 12/2014 | Fehr | E02F 9/265 701/50 |
| 9,234,329 | B2 | 1/2016 | Jaliwala et al. | |
| 9,279,235 | B1 | 3/2016 | Becicka et al. | |
| 9,328,479 | B1 | 5/2016 | Rausch et al. | |
| 9,551,130 | B2 | 1/2017 | Hendron et al. | |
| 9,567,731 | B2 | 2/2017 | Darukhanavala et al. | |
| 9,624,643 | B2 | 4/2017 | Hendron et al. | |
| 10,392,774 | B2 | 8/2019 | Dauderman | |
| 10,962,360 | B2 * | 3/2021 | Olgesby | G01C 9/00 |

(Continued)

*Primary Examiner* — Gary S Hartmann

(74) *Attorney, Agent, or Firm* — Gary L. Montle; Lucian Wayne Beavers; Patterson Intellectual Property Law, PC

(57) ABSTRACT

A system and method for adaptive calibration of a self-propelled work vehicle comprising a chassis and a blade front-mounted thereto for working a ground surface. First sensor signals correspond to a blade slope, and second sensor signals correspond to a chassis slope. During a first operating mode, a blade position is controlled relative to the chassis, based at least on a stored calibration value and a detected difference between the blade slope and a target slope of the ground surface, and a difference is also determined between the chassis slope and the target slope of the ground surface. During a second operating mode, the position of the blade is controlled relative to the chassis until the chassis slope corresponds to the target slope of the ground surface, and the stored calibration value is altered based on adjustments to the blade position during the second operating mode.

20 Claims, 4 Drawing Sheets

(56) References Cited

U.S. PATENT DOCUMENTS

| | | | | |
|---|---|---|---|---|
| 2011/0213529 | A1 | 9/2011 | Krause et al. | |
| 2013/0080112 | A1 | 3/2013 | Friend | |
| 2014/0343800 | A1 | 11/2014 | Nelson et al. | |
| 2019/0234045 | A1 | 8/2019 | Wiewel et al. | |
| 2019/0368160 | A1 | 12/2019 | Green et al. | |
| 2021/0087777 | A1* | 3/2021 | Kenkel | E02F 9/2041 |
| 2021/0148093 | A1* | 5/2021 | Shimada | E02F 9/2228 |

* cited by examiner

SYSTEM AND METHOD FOR ADAPTIVE CALIBRATION OF BLADE POSITION CONTROL ON SELF-PROPELLED WORK VEHICLES

FIELD OF THE DISCLOSURE

The present disclosure relates generally to self-propelled work vehicles such as working machines in the construction and/or agricultural industries which include implements mounted thereon for working the terrain. More particularly, the present disclosure relates to systems and methods configured to control the position of a work implement such as a blade for engaging a ground surface with respect to a target profile.

BACKGROUND

Self-propelled work vehicles of this type may for example include dozers, compact track loaders, excavator machines, skid steer loaders, and other self-propelled machines which grade or otherwise modify the terrain or equivalent working environment in some way. Work vehicles with ground-engaging blades may be used to shape and smooth ground surfaces.

Calibrating a grade control system on a crawler is a difficult and time-consuming process. On a crawler with two-dimensional slope control, error in the calibration will affect the absolute accuracy of the grade because there is no outside reference (GPS, laser, etc.) to correct for this. Further complicating matters, numerous other factors can equally affect the grading performance such as grouser wear, blade edge wear, blade pitch setting, and ground conditions. Accordingly, there is never a "perfect" calibration.

To account for these changing conditions, conventional slope control systems may include operator adjustable settings. This is a manual process performed via, e.g., an onboard user interface and can be challenging to implement properly. An operator may frequently find it necessary to adjust the settings because the machine is not performing optimally due to these changing conditions.

BRIEF SUMMARY

The current disclosure provides an enhancement to conventional systems, at least in part by introducing a novel system and method with a secondary calibration routine to adjust for all of the factors mentioned above and obtain consistent work vehicle performance without the need for constant manual adjustments. It could also allow for a simplified primary calibration routine because errors in the primary routine will be easily corrected for in the secondary routine.

In one embodiment, a method is disclosed herein for operating a self-propelled work vehicle comprising a chassis and a blade front-mounted thereto for working a ground surface. A first sensor generates signals corresponding to at least a slope of the blade, and A second sensor generates signals corresponding to at least a slope of the chassis. During a first (e.g., "normal") operating mode, a position of the blade is controlled relative to the chassis, based at least on a stored calibration value and a detected difference between the slope of the blade and a target slope of the ground surface, and a difference is determined between the slope of the chassis and the target slope of the ground surface. During a second operating mode, the position of the blade is controlled relative to the chassis until the slope of the chassis corresponds to the target slope of the ground surface, and the stored calibration value is altered based on adjustments to the position of the blade during the second operating mode.

In an exemplary aspect further in accordance with the above-referenced embodiment, the second operating mode may be manually initiated via a user interface and implemented over a predetermined time and/or distance. The second operating mode may further be implemented with respect to an area with a ground surface having a predetermined slope.

In another exemplary aspect in accordance with the above-referenced embodiment, the second operating mode may be automatically implemented and/or maintained based on the determined difference between the slope of the chassis and the target slope of the ground surface, and further based on determining that one or more predetermined conditions are satisfied.

In another exemplary aspect in accordance with the above-referenced embodiment, the one or more predetermined conditions may comprise determining that the blade is engaging the ground surface. The blade may for example be determined to be engaging the ground surface at least in part via a detected rimpull value.

In another exemplary aspect in accordance with the above-referenced embodiment, the one or more predetermined conditions may comprise detecting forward movement of the chassis.

In another exemplary aspect in accordance with the above-referenced embodiment, the one or more predetermined conditions may comprise detecting that a current location of the chassis corresponds to a location previously engaged by the blade.

In another exemplary aspect in accordance with the above-referenced embodiment, a distance traveled by the chassis may be detected relative to an engagement of the ground surface by the blade.

In another exemplary aspect in accordance with the above-referenced embodiment, an output signal may be generated for displaying one or more of: the difference between the slope of the chassis and the target slope of the ground surface; and an alert that the difference between the slope of the chassis and the target slope of the ground surface exceeds a predetermined threshold.

In another embodiment, a self-propelled work vehicle includes a chassis, a blade front-mounted to the chassis for working a ground surface, a first sensor configured to generate one or more signals corresponding to at least a slope of the blade, a data storage medium having stored thereon at least a calibration value for the one or more signals corresponding to the at least slope of the blade, a second sensor configured to generate one or more signals corresponding to at least a slope of the chassis, and a controller communicatively linked to the first sensor and the second sensor. The controller is configured for a first operating mode and a second operating mode to direct the performance of respective steps or operations according to the above-referenced method embodiment and associated exemplary aspects.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
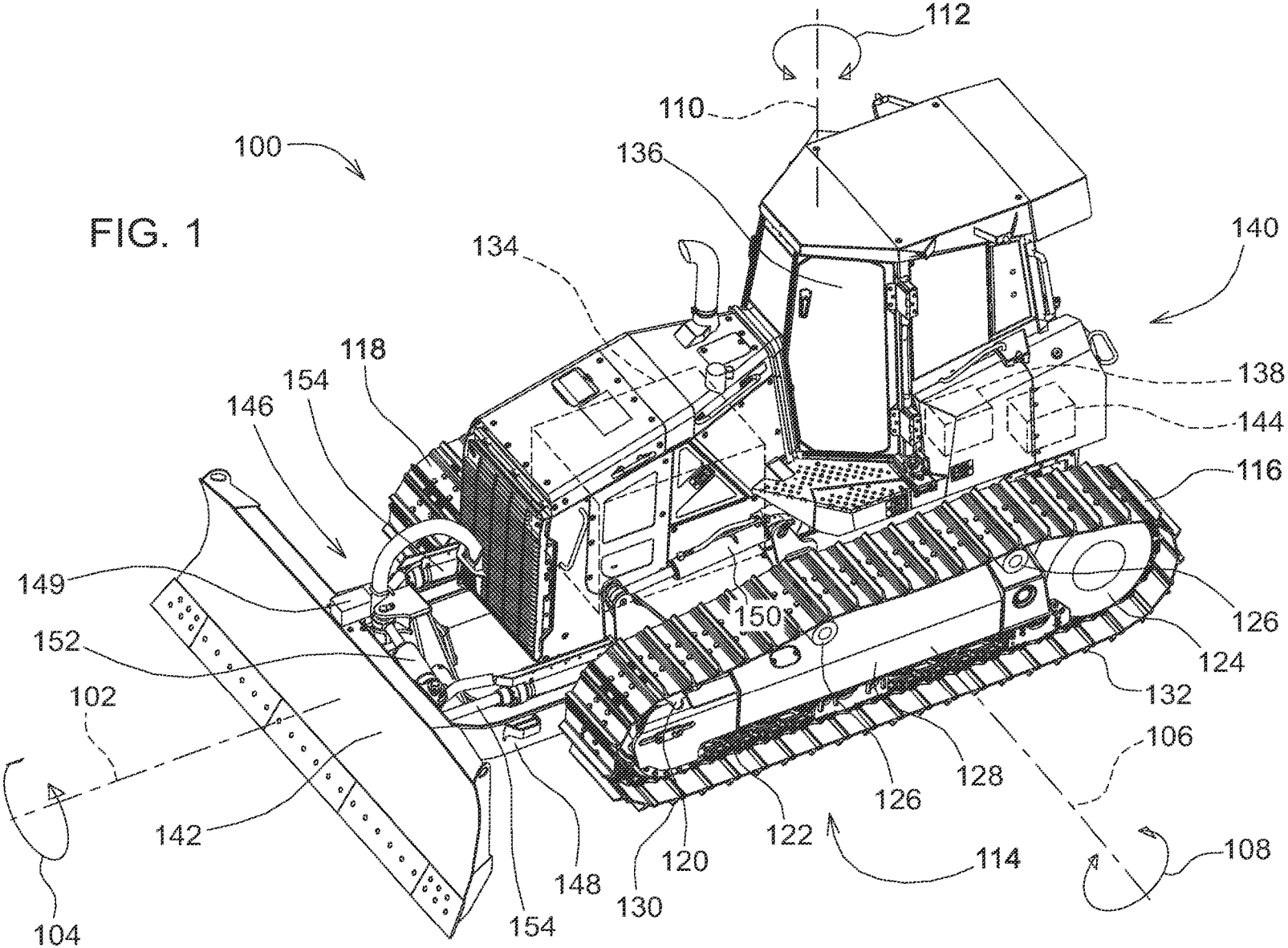
FIG. 1 is a perspective view of a tracked work vehicle incorporating an embodiment of a self-propelled work vehicle and method as disclosed herein.

FIG. 1 is a perspective view of a work vehicle 100. In the illustrated embodiment, the work vehicle 100 is a crawler dozer, but may be any work vehicle with a ground-engaging blade 142 or work implement 142 such as a compact track loader, motor grader, scraper, skid steer, backhoe, and tractor, to name but a few examples. The work vehicle may be operated to engage the ground and grade, cut, and/or move material to achieve simple or complex features on the ground. While operating, the work vehicle may experience movement in three directions and rotation in three directions. A direction for the work vehicle may also be referred to with regard to a longitudinal direction 102, a latitudinal or lateral direction 106, and a vertical direction 110. Rotation for work vehicle 100 may be referred to as roll 104 or the roll direction, pitch 108 or the pitch direction, and yaw 112 or the yaw direction or heading.

An operator's cab 136 may be located on the chassis 140. The operator's cab and the working implement 142 may both be mounted on the chassis 140 so that at least in certain embodiments the operator's cab faces in the working direction of the working implement 142, such as for example where the implement is front-mounted. A control station including a user interface (not shown) may be located in the operator's cab 136. As used herein, directions with regard to work vehicle 100 may be referred to from the perspective of an operator seated within the operator cab 136: the left of work vehicle is to the left of such an operator, the right of work vehicle is to the right of such an operator, the front or fore of work vehicle 100 is the direction such an operator faces, the rear or aft of work vehicle is behind such an operator, the top of work vehicle is above such an operator, and the bottom of work vehicle is below such an operator.

The term "user interface" as used herein may broadly take the form of a display unit 166 and/or other outputs from the system such as indicator lights, audible alerts, and the like. The user interface may further or alternatively include various controls or user inputs (e.g., a steering wheel, joysticks, levers, buttons) for operating the work vehicle 100, including operation of the engine, hydraulic cylinders, and the like. Such an onboard user interface may be coupled to a vehicle control system via for example a CAN bus arrangement or other equivalent forms of electrical and/or electro-mechanical signal transmission. Another form of user interface (not shown) may take the form of a display unit 166 that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

The illustrated work vehicle 100 further includes a control system including a controller 138. The controller 138 may be part of the machine control system of the working machine, or it may be a separate control module. Accordingly, the controller 138 may generate control signals for controlling the operation of various actuators throughout the work vehicle 100, which may for example be hydraulic motors, hydraulic piston-cylinder units, electric actuators, or the like. Electronic control signals from the controller 138 may for example be received by electro-hydraulic control valves 156 associated with respective actuators, wherein the electro-hydraulic control valves 156 control the flow of hydraulic fluid to and from the respective hydraulic actuators to control the actuation thereof in response to the control signal from the controller 138.

The controller 138 may include or be functionally linked to the user interface and optionally be mounted in the operators cab 136 at a control panel.

The controller 138 is configured to receive input signals from some or all of various sensors associated with the work vehicle 100, which in the present disclosure at least includes a first sensor (or set of one or more sensors) 144 affixed to the chassis 140 of the work vehicle 100 and configured to provide a signal indicative of an inclination (slope) of the chassis, and a second sensor (or set of one or more sensors) 149 associated with a blade positioning unit 200 and configured to provide at least a signal indicative of a blade inclination (slope). In alternative embodiments, the first sensor 144 may not be affixed directly to the chassis but may instead be connected to the chassis 140 through intermediate components or structures, such as rubberized mounts. In these alternative embodiments, the sensor 144 is not directly affixed to the chassis 140 but is still connected to the chassis 140 at a fixed relative position so as to experience the same motion as the chassis 140.

The sensor 144 may be configured to provide at least a signal indicative of the inclination of the chassis 140 relative to the direction of gravity. The sensor 144 may also be configured to provide a signal or signals indicative of other positions or velocities of the chassis, including its angular position, velocity, or acceleration in a direction such as the direction of roll 104, pitch 108, yaw 112, or its linear acceleration in a longitudinal 102, latitudinal 106, and/or vertical 110 direction. The sensor 144 may be configured to directly measure inclination, or for example to measure angular velocity and integrate to arrive at inclination.

The sensor 144 may typically, e.g., be comprised of an inertial measurement unit (IMU) mounted on the chassis 140 and configured to provide at least a chassis inclination (slope) signal, or signals corresponding to the scope of the chassis 140, to the controller 138 as inputs for the method as further disclosed below. Such an IMU 144 may for example be in the form of a three-axis gyroscopic unit configured to detect changes in orientation of the sensor, and thus of the chassis 140 to which it is fixed, relative to an initial orientation.

In other embodiments, the sensors may include a plurality of GPS sensing units fixed relative to the chassis 140 and/or the blade positioning unit, which can detect the absolute position and orientation of the work vehicle 100 within an external reference system, and can detect changes in such position and orientation, and/or a camera based system which can observe surrounding structural features via image processing, and can respond to the orientation of the working machine 100 relative to those surrounding structural features.

The controller 138 in an embodiment (not shown) may include or may be associated with a processor, a computer readable medium, a communication unit, data storage such as for example a database network, and the aforementioned user interface or control panel having a display 166. An input/output device, such as a keyboard, joystick or other user interface tool, may be provided so that the human operator may input instructions to the controller 138. It is understood that the controller 138 described herein may be a single controller having all of the described functionality, or it may include multiple controllers wherein the described functionality is distributed among the multiple controllers.

Various operations, steps or algorithms as described in connection with the controller 138 can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit may support or provide communications between the controller 138 and external systems or devices, and/or support or provide communication interface with respect to internal components of the work vehicle 100. The communications unit may include wireless communication system components (e.g., via cellular modem, WiFi, Bluetooth or the like) and/or may include one or more wired communications terminals such as universal serial bus ports.

Data storage as discussed herein may, unless otherwise stated, generally encompass hardware such as volatile or non-volatile storage devices, drives, memory, or other storage media, as well as one or more databases residing thereon.

The work vehicle 100 is supported on the ground by an undercarriage 114. The undercarriage 114 includes ground engaging units 116, 118, which in the present example are formed by a left track 116 and a right track 118, and provide tractive force for the work vehicle 100. Each track may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of the work vehicle 100, provide support for the work vehicle 100 on the ground. Front idlers 120, track rollers 122, rear sprockets 124, and top idlers 126 are all pivotally connected to the remainder of the work vehicle 100 and rotationally coupled to their respective tracks so as to rotate with those tracks. The track frame 128 provides structural support or strength to these components and the remainder of the undercarriage 114. In alternative embodiments, the ground engaging units 116, 118 may comprise, e.g., wheels on the left and right sides of the work vehicle.

Front idlers 120 are positioned at the longitudinal front of the left track 116 and the right track 118 and provide a rotating surface for the tracks to rotate about and a support point to transfer force between the work vehicle 100 and the ground. The left and right tracks 116, 118 rotate about the front idlers 120 as they transition between their vertically lower and vertically upper portions parallel to the ground, so approximately half of the outer diameter of each of the front idlers 120 is engaged with the respective left 116 or right track 118. This engagement may be through a sprocket and pin arrangement, where pins included in the left 116 and right tracks 118 are engaged by recesses in the front idler 120 so as to transfer force. This engagement also results in the vertical height of the left and right tracks 116, 118 being only slightly larger than the outer diameter of each of the front idlers 120 at the longitudinal front of the tracks. Forward engaging points 130 of the tracks 116, 118 can be approximated as the point on each track vertically below the center of the front idlers 120, which is the forward point of the tracks which engages the ground.

Track rollers 122 are longitudinally positioned between the front idler 120 and the rear sprocket 124 along the bottom left and bottom right sides of the work vehicle 100. Each of the track rollers 122 may be rotationally coupled to the left track 116 or the right track 118 through engagement between an upper surface of the tracks and a lower surface of the track rollers 122. This configuration may allow the track rollers 122 to provide support to the work vehicle 100, and in particular may allow for the transfer of forces in the vertical direction between the work vehicle and the ground. This configuration also resists the upward deflection of the left and right tracks 116, 118 as they traverse an upward ground feature whose longitudinal length is less than the distance between the front idler 120 and the rear sprocket 124.

Rear sprockets 124 may be positioned at the longitudinal rear of each of the left track 116 and the right track 118 and, similar to the front idlers 120, provide a rotating surface for the tracks to rotate about and a support point to transfer force between the work vehicle 100 and the ground. The left and right tracks 116, 118 rotate about the rear sprockets as they transition between their vertically lower and vertically upper portions parallel to the ground, so approximately half of the outer diameter of each of the rear sprockets 124 is engaged with the respective left or right track 116, 118. This engagement may be through a sprocket and pin arrangement, where pins included in the left and right tracks are engaged by recesses in the rear sprockets 124 to transfer force. This engagement also results in the vertical heights of the tracks being only slightly larger than the outer diameter of each of the rear sprockets 124 at the longitudinal back or rear of the respective track. The rearmost engaging point 132 of the tracks can be approximated as the point on each track vertically below the center of the rear sprockets, which is the rearmost point of the track which engages the ground. In this embodiment, each of the rear sprockets 124 may be powered by a rotationally coupled hydraulic motor so as to drive the left track 116 and the right track 118 and thereby control propulsion and traction for the work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by an engine 134 (or equivalent power source) of the work vehicle and may be controlled by an operator in the operator cab 136 issuing commands which may be received by the controller 138 and communicated to the left and right hydrostatic pumps. In alternative embodiments, each of the rear sprockets may be driven by a rotationally coupled electric motor or a mechanical system transmitting power from the engine.

Top idlers 126 are longitudinally positioned between the front idlers 120 and the rear sprockets 124 along the left and right sides of the work vehicle 100 above the track rollers 122. Similar to the track rollers, each of the top idlers may be rotationally coupled to the left track 116 or the right track 118 through engagement between a lower surface of the tracks and an upper surface of the top idlers. This configuration may allow the top idlers to support the tracks for the longitudinal span between the front idler and the rear sprocket and prevent downward deflection of the upper portion of the tracks parallel to the ground between the front idler and the rear sprocket.

The undercarriage 114 is affixed to, and provides support and tractive effort for, the chassis 140 of the work vehicle 100. The chassis is the frame which provides structural support and rigidity to the work vehicle, allowing for the transfer of force between the blade 142 and the left track 116 and right track 118. In this embodiment, the chassis is a weldment comprised of multiple formed and joined steel members, but in alternative embodiments it may be comprised of any number of different materials or configurations.

The blade 142 is a work implement which may engage the ground or material, for example to move material from one location to another and to create features on the ground, including flat areas, grades, hills, roads, or more complexly shaped features. In this embodiment, the blade of the work vehicle 100 may be referred to as a six-way blade, six-way adjustable blade, or power-angle-tilt (PAT) blade. The blade may be hydraulically actuated to move vertically up or down ("lift"), roll left or right ("tilt"), and yaw left or right ("angle"). Alternative embodiments may utilize a blade with fewer hydraulically controlled degrees of freedom, such as a 4-way blade that may not be angled or actuated in the direction of yaw 112.

The blade 142 is movably connected to the chassis 140 of the work vehicle 100 through a linkage 146 which supports and actuates the blade and is configured to allow the blade to be lifted (i.e., raised or lowered in the vertical direction 110) relative to the chassis. The linkage may include multiple structural members to carry forces between the blade and the remainder of the work vehicle and may provide attachment points for hydraulic cylinders which may actuate the blade in the lift, tilt, and angle directions. A "blade positioning unit" 200 as referred to herein, and as further described below with respect to FIG. 2, may for example comprise the linkage, along with the hydraulic cylinders, and additional and/or equivalent structures associated with actuation of the blade in the lift, tilt, and angle directions.

The linkage 146 includes a c-frame 148, a structural member with a C-shape positioned rearward of the blade 142, with the C-shape open toward the rear of the work vehicle 100. Each rearward end of the c-frame is pivotally connected to the chassis 140 of the work vehicle 100, such as through a pin-bushing joint, allowing the front of the c-frame to be raised or lowered relative to the work vehicle about the pivotal connections at the rear of the c-frame. The front portion of the c-frame, which is approximately positioned at the lateral center of the work vehicle, connects to the blade through a ball-socket joint. This allows the blade three degrees of freedom in its orientation relative to the c-frame (lift-tilt-angle) while still transferring rearward forces on the blade to the remainder of the work vehicle.

The blade 142 may be lifted (i.e., raised or lowered) relative to the work vehicle 100 by the actuation of lift cylinders 150, which may raise and lower the c-frame 148. For each of the lift cylinders, the rod end is pivotally connected to an upward projecting clevis of the c-frame and the head end is pivotally connected to the remainder of the work vehicle just below and forward of the operator cab 136. The configuration of the linkage 146 and the positioning of the pivotal connections for the head end and rod end of the lift cylinders results in the extension of the lift cylinders lowering the blade and the retraction of the lift cylinders raising the blade. In alternative embodiments, the blade may be raised or lowered by a different mechanism, or the lift cylinders may be configured differently, such as a configuration in which extension of the lift cylinders raises the blade and retraction of the lift cylinders lowers the blade. In a particular embodiment, at least one of a second set of sensors 149 is preferably located in association with the lift cylinders, for example to generate an output signal corresponding to an extension of the lift cylinders.

The second sensor 149, like the first sensor 144, may be configured to provide at least a blade inclination signal, which indicates the angle of the blade relative to gravity. In certain embodiments, the sensor 149 may be configured to further or instead measure an angle of the linkage 146, such as an angle between the linkage 146 and the chassis 140, in order to determine a position of the blade. In other alternative embodiments, the sensor 149 may be configured to measure a position of the blade by measuring a different angle, such as one between the linkage and the blade, or the linear displacement of a cylinder attached to the linkage or the blade.

The blade 142 may be tilted relative to the work vehicle 100 by the actuation of a tilt cylinder 152, which may also be referred to as moving the blade in the direction of roll 104. The rod end of the tilt cylinder is pivotally connected to a clevis positioned on the back and left sides of the blade above the ball-socket joint between the blade and the c-frame and the head end is pivotally connected to an upward projecting portion of the linkage 146. The positioning of the pivotal connections for the head end and the rod end of the tilt cylinder result in extension of the tilt cylinder tilting the blade to the left (or counterclockwise when viewed from the operator cab 136) and retraction of the tilt cylinder tilting the blade to the right (or clockwise when viewed from the operator cab. In alternative embodiments, the blade may be tilted by a different mechanism (e.g., an electrical or hydraulic motor) or the tilt cylinder may be configured differently, such as a configuration in which it is mounted vertically and positioned on the left or right side of the blade, or a configuration with two tilt cylinders.

The blade 142 may be angled relative to the work vehicle 100 by the actuation of angle cylinders 154, which may also be referred to as moving the blade in the direction of yaw 112. For each of the angle cylinders 154, the rod end is pivotally connected to a clevis of the blade 142 while the head end is pivotally connected to a clevis of the c-frame 148. One of the angle cylinders 154 is positioned on the left side of the work vehicle 100, left of the ball-socket joint between the blade 142 and the c-frame 148, and the other of the angle cylinders 154 is positioned on the right side of the work vehicle 100, right of the ball-socket joint between the blade 142 and the c-frame 148. This positioning results in the extension of the left of the angle cylinders 154 and the retraction of the right of the angle cylinders 154 angling the blade 142 rightward, or yawing the blade 142 clockwise when viewed from above, and the retraction of left of the angle cylinders 154 and the extension of the right of the angle cylinders 154 angling the blade 142 leftward, or yawing the blade 142 counterclockwise when viewed from above. In alternative embodiments (not shown), the blade 142 may be angled by a different mechanism or the angle cylinders 154 may be configured differently.

Due to the geometry of the linkage 146 in this embodiment, the blade 142 is not raised or lowered in a perfectly vertical line with respect to the work vehicle 100. Instead, a point on the blade 142 would trace a curve as the blade is raised and lowered. This means that the vertical component of the velocity of the blade 142 is not perfectly proportional to the linear velocity with which the lift cylinders 150 are extending or retracting, and the vertical component of the blade's velocity may vary even when the linear velocity of the lift cylinders 150 is constant. This also means that the lift cylinders 150 have a mechanical advantage which varies depending on the position of the linkage 146. Given a kinematic model of the blade 142 and the linkage 146 (e.g., formula(s) or table(s) providing a relationship between the position and/or movement of portions of the blade and the linkage) and the state of the blade and the linkage (e.g., sensor(s) sensing one or more positions, angles, or orientations of the blade or linkage, such as the sensor 149), at least with respect to blade lift, the controller 138 may compensate for such non-linearity. Incomplete or simplified kinematic models may be used if there is a need to only focus on particular motion relationships (e.g., only those affecting blade lift) or if only limited compensation accuracy is desired. The controller 138 may utilize this compensation and a desired velocity, for example a command to raise the blade 142 at a particular vertical velocity, to issue a command that may achieve a flow rate into the lift cylinders 150 that results in the blade 142 being raised at the particular vertical velocity regardless of the current position of the linkage 146. For example, the controller 138 may issue commands which vary the flow rate into the lift cylinders 150 in order to achieve a substantially constant vertical velocity of the blade 142.

Similarly, due to the positioning of the tilt cylinder 152 and the angle cylinders 154 and the configuration of their connection to the blade 142, the angular velocity of the blade tilt and angle is not perfectly proportional to the linear velocity of the tilt cylinder and the angle cylinders, respectively, and the angular velocity of tilt and angle may vary even when the linear velocity of the tilt cylinder 152 and angle cylinders 154, respectively, is constant. This also means that the tilt cylinder 152 and the angle cylinders 154 each have a mechanical advantage which varies depending on the position of the blade 142. Much like with the lift cylinders 150, given a kinematic model of the blade 142 and the linkage 146, and the state of the blade 142 and the linkage 146, at least with respect to the blade tilt and angle, the controller 138 may compensate for such non-linearity. Incomplete or simplified kinematic models may be used if there is a need to only focus on particular motion relationships (e.g., only those affecting blade tilt and angle) or if only limited compensation accuracy is required. The controller 138 may utilize this compensation and a desired angular velocity, for example a command to tilt or angle the blade 142 at a particular angular velocity, to issue commands that may vary the flow rate into the tilt cylinder 152 or angle cylinders 154 to result in the blade 142 being tilted or angled at the particular angular velocity regardless of the current position of the blade 142 or linkage 146.

In alternative embodiments, the blade 142 may be connected to the remainder of the work vehicle 100 in a manner which tends to make the blade lift velocity (in the vertical direction 110), tilt angular velocity (in the direction of roll 104), or angle angular velocity (in the direction of yaw 112) proportional to the linear velocity of the lift cylinders 150, tilt cylinder 152, or angle cylinders 154, respectively. This may be achieved with particular designs of the linkage 146 and positioning of the pivotal connections of the lift cylinders, tilt cylinder, and angle cylinders. In such alternative embodiments, the controller 138 may not need to compensate for non-linear responses of the blade 142 to the actuation of the lift cylinders, tilt cylinder, and angle cylinders, or the need for compensation may be reduced.

Each of the lift cylinders 150, tilt cylinder 152, and angle cylinders 154 is a double acting hydraulic cylinder. One end of each cylinder may be referred to as a head end, and the end of each cylinder opposite the head end may be referred to as a rod end. Each of the head end and the rod end may be fixedly connected to another component or, as in this embodiment, pivotally connected to another component, such as a through a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder.

Figure 2:
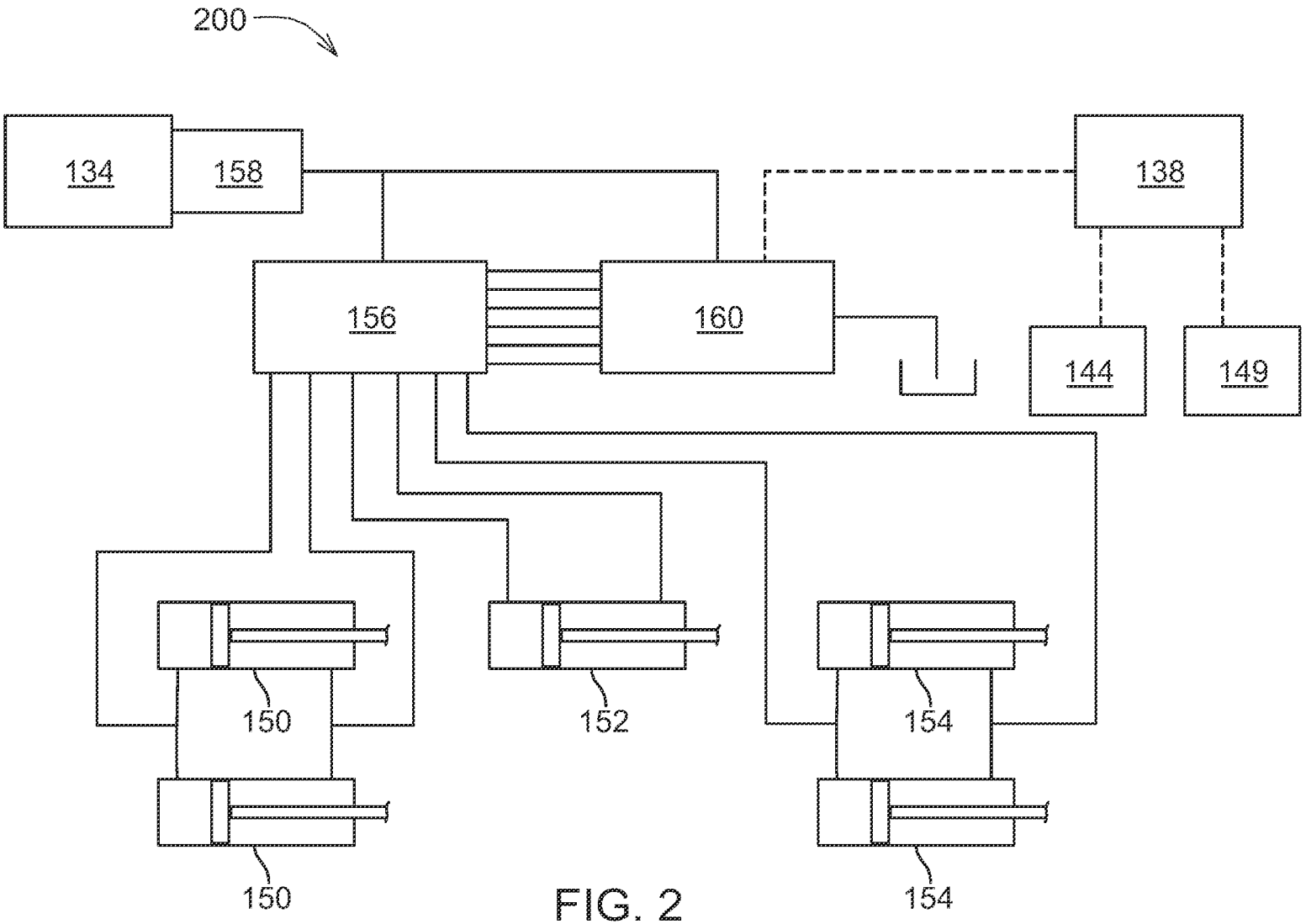
FIG. 2 is a block diagram of an exemplary blade positioning unit according to the embodiment of the tracked work vehicle of FIG. 1.

FIG. 2 is an illustrative schematic of a blade positioning unit 200, for example including hydraulic and electrical components for controlling a position of the blade 142. Each of the lift cylinders 150, the tilt cylinder 152, and the angle cylinders 154 is hydraulically connected to a hydraulic control valve 156, which may be positioned in an interior area of the work vehicle 100. The hydraulic control valve 156 may also be referred to as a valve assembly or manifold. The hydraulic control valve 156 receives pressurized hydraulic fluid from a hydraulic pump 158, which may be rotationally connected to the engine 134, and directs such fluid to the lift cylinders 150, the tilt cylinder 152, the angle cylinders 154, and other hydraulic circuits or functions of the work vehicle 100. The hydraulic control valve 156 may meter such fluid out or control the flow rate of hydraulic fluid to each hydraulic circuit to which it is connected. In alternative embodiments, the hydraulic control valve 156 may not meter such fluid out but may instead only selectively provide flow paths to these functions while metering is performed by another component (e.g., a variable displacement hydraulic pump 158) or not performed at all. The hydraulic control valve 156 may meter such fluid out through a plurality of spools, whose positions control the flow of hydraulic fluid, and other hydraulic logic. The spools (not shown) may be actuated by solenoids, pilots (e.g., pressurized hydraulic fluid acting on the spool), the pressure upstream or downstream of the spool, or some combination of these and other elements.

In accordance with the embodiment illustrated in FIG. 1, the spools of the hydraulic control valve 156 are shifted by pilots whose pressure is controlled, at least in part, by an electrohydraulic pilot valve 160 in communication with the controller 138. The electrohydraulic pilot valve 160 is positioned within an interior area of the work vehicle 100 and receives pressurized hydraulic fluid from a hydraulic source and selectively directs such fluid to pilot lines hydraulically connected to the hydraulic control valve 156. In this embodiment the hydraulic control valve 156 and the electrohydraulic pilot valve 160 are separate components, but in alternative embodiments the two valves may be integrated into a single valve assembly or manifold. In this embodiment, the hydraulic source is a hydraulic pump 158. In alternative embodiments, a pressure reducing valve may be used to reduce the pressure of pressurized hydraulic fluid provided by the hydraulic pump 158 to a set pressure, for example 600 pounds per square inch, for usage by the electrohydraulic pilot valve 160. In the embodiment illustrated in FIG. 2, individual valves within the electrohydraulic pilot valve 160 reduce the pressure from the received hydraulic fluid via solenoid-actuated spools which may drain hydraulic fluid to a hydraulic reservoir. In this embodiment, the controller 138 actuates these solenoids by sending a specific current to each (e.g., 600 mA). In this way, the controller 138 may actuate the blade 142 by issuing electrical commands signals to the electrohydraulic pilot valve 160, which in turn provides hydraulic signals (pilots) to the hydraulic control valve 156, which shift spools to direct hydraulic flow from the hydraulic pump 158 to actuate the lift cylinders 150, the tilt cylinder 152, and the angle cylinders 154. In this embodiment, the controller 138 is in direct communication with the electrohydraulic pilot valve 160 via electrical signals sent through a wire harness and is indirectly in communication with the hydraulic control valve 156 via the electrohydraulic pilot valve 160.

In alternative embodiments, the controller 138 may be configured to send a command to actuate the blade 142 in a number of different manners. As one example, the controller 138 may be in communication with a valve controller via a controlled area network (CAN) and may send command signals to the valve controller in the form of CAN messages. The valve controller may receive these messages from the controller 138 and send current to specific solenoids within the electrohydraulic pilot valve 160 based on those messages. As another example, the controller 138 may be configured to actuate the blade 142 by actuating an input in the operator cab 136. For example, an operator may use a joystick to issue commands to actuate the blade 142, and the joystick may generate hydraulic pressure signals, pilots, which are communicated to the hydraulic control valve 156 to cause the actuation of the blade 142. In such a configuration, the controller 138 may be in communication with electrical devices (e.g., solenoids, motors) which may actuate a joystick in the operator cab. In this way, the controller 138 may be configured to actuate the blade 142 by actuating these electrical devices instead of communicating signals to electrohydraulic pilot valve 160.

Figure 3:
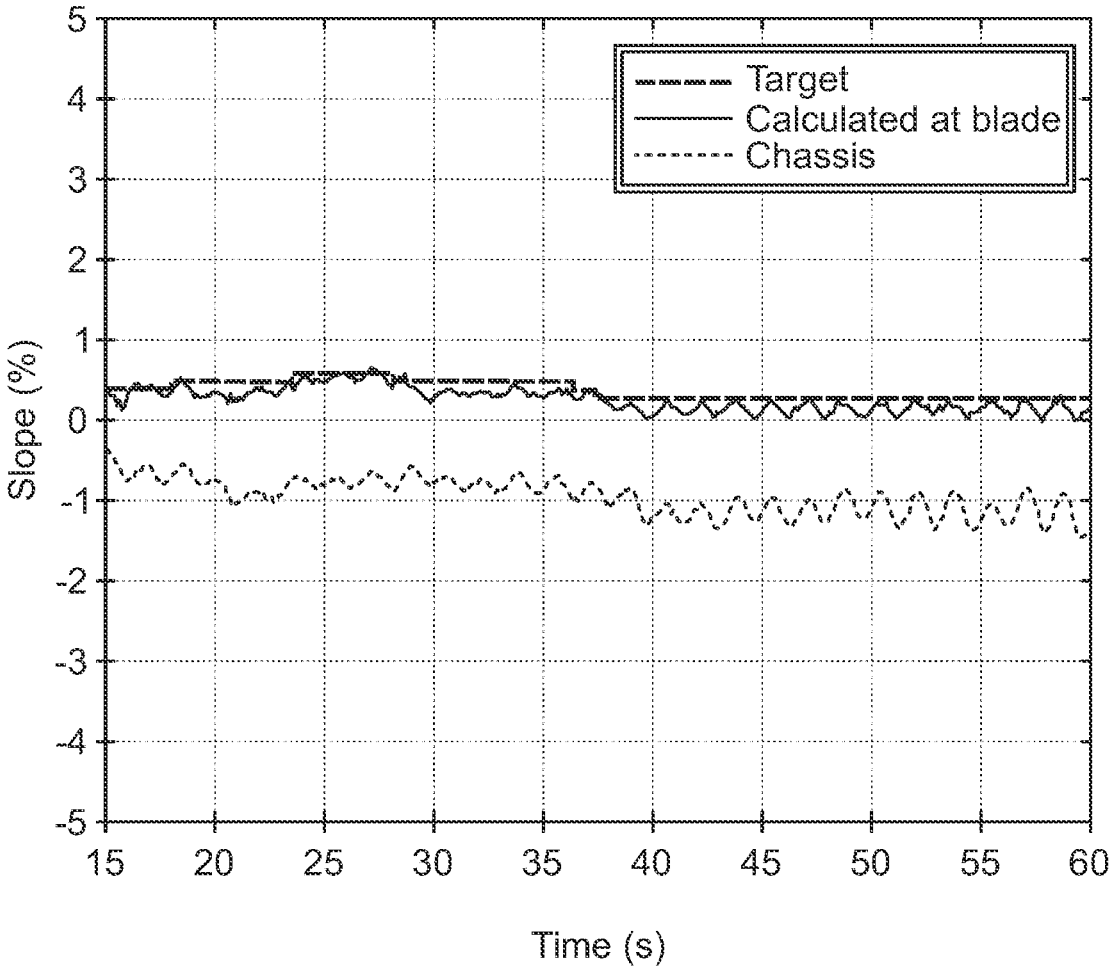
FIG. 3 is a graphical diagram representing an exemplary discrepancy between the cut slope of a ground surface as measured at the blade and the cut slope of the same ground surface as measured at the chassis.

Turning next to FIG. 3, the illustrated plot an example of conventional error in the calibration of a crawler dozer 100 that would affect the absolute accuracy of the grade in the absence of a secondary calibration process as disclosed herein, for example because there is no outside reference (e.g., GPS, laser) to provide correction. The illustrated values for the slope calculated at the blade 142, relative to the target slope value, indicate that the work vehicle controller 138 believes the target slope to be achieved, but the chassis rotation as the work vehicle drives over the cut profile shows a ~1.2% slope error.

Figure 4:
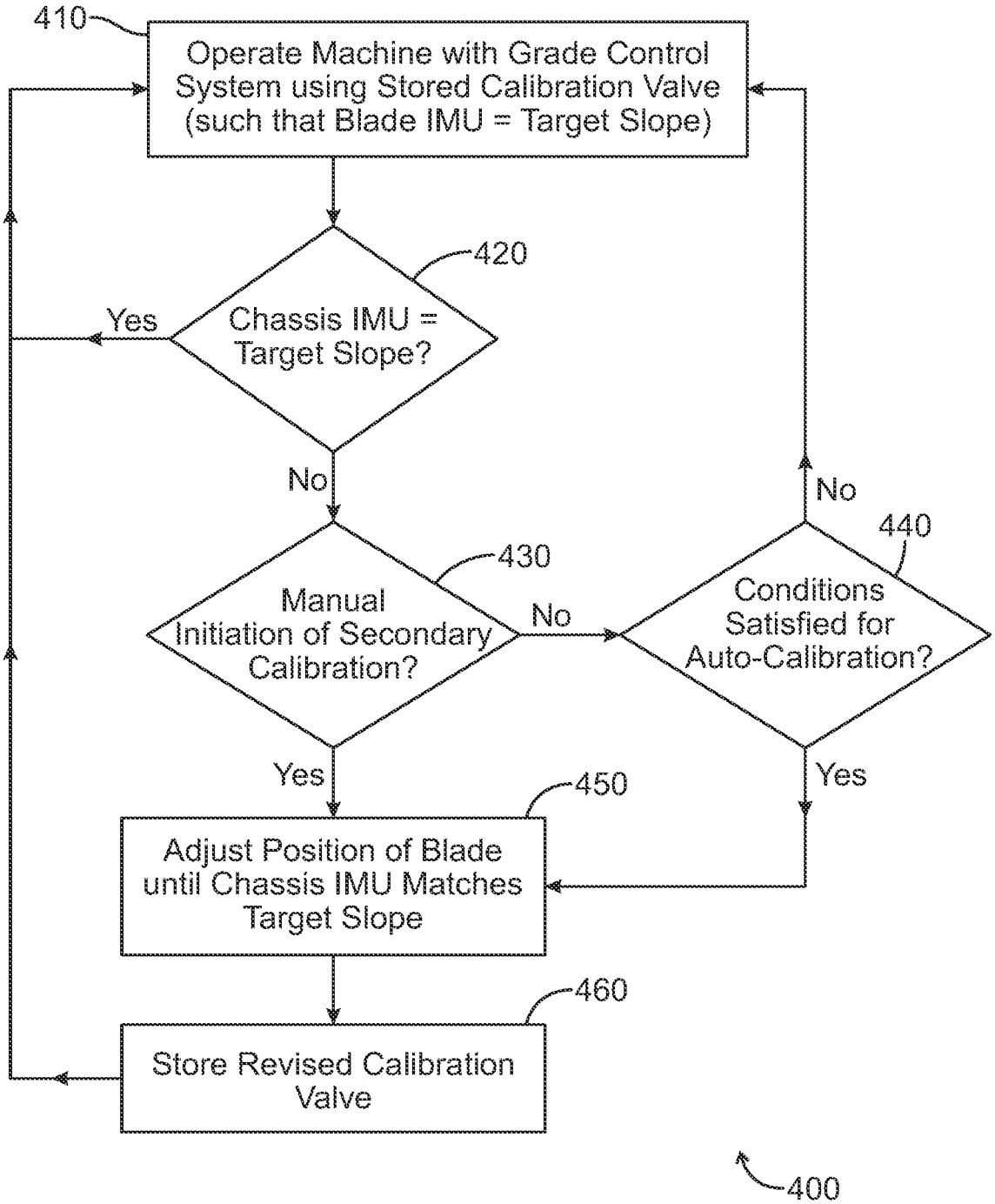
FIG. 4 is a block diagram representing an exemplary method of operation of a self-propelled work vehicle as disclosed herein.

Referring next to FIG. 4, an exemplary method 400 as described below may preferably include a secondary calibration process to adjust for complicating factors that otherwise affect grading performance (e.g., grouser wear, blade edge wear, blade pitch setting, ground conditions, etc.) and facilitate consistent machine performance.

The illustrated method begins by operating a work vehicle 100 as disclosed herein (e.g., a crawler dozer) by simply making a cut with the crawler during normal/conventional operation, wherein the controller 138 uses integral control built into the existing slope control software and stored calibration values to make adjustments to the blade position, such that the detected blade position corresponds to a target slope (step 410).

Because the crawler 100 drives over the profile of the road surface that it just cut, inputs from a chassis position sensor such as an inertial measurement unit (IMU) to the controller 138 confirm (step 420) whether or not the primary grade control calibration is correct (i.e., whether the chassis IMU readings correspond to the target slope). If so (i.e., "yes" with respect to the query in step 420), the method 400 may simply return to step 410 and continue with normal operation. If not, (i.e., "no" with respect to the query in step 420), the chassis IMU may provide the respective inputs to the controller 138 as a basis for minor adjustments to the primary calibration routine so the work vehicle 100 achieves the desired target profile. This may be implemented in steps 450, 460 by simply continuing to make cuts with the crawler blade 142, but further making automatic adjustments to the calibration value and to the blade position until the cut at the blade 142 is confirmed as achieving the target slope (i.e., the chassis IMU readings corresponding to the target slope) and then storing a new calibration value for further iterations of normal operation. This stored value may also be made available, e.g., displayed via a display unit 166 of an onboard user interface, for operators to make further adjustments as desired.

In various exemplary conditions, there may be times when the aforementioned method 400 requires selective implementation, wherein the secondary calibration could otherwise cause more harm than good. One such example may include wherein the work vehicle 100 is sitting still or moving very slowly, as adjustments to the blade 142 may continue to occur even though the resulting profile has not yet been driven over by the chassis 140 and result in overshoot of the target value.

Another example may include a case wherein the blade 142 is currently positioned above the ground surface. If the desired slope is above the current ground profile and the blade 142 is hovering in the air, the control system 138 may mistakenly ascertain that the blade 142 is digging too far into the ground and command it to a higher position, upon which the controller 138 still does not see any change to the ground profile and foreseeably continues to command the blade 142 to higher positions.

Accordingly, additional steps may be provided in the method 400 such that the controller 138 does not simply close the loop on the error between the chassis slope and the target slope.

In an embodiment, the secondary calibration may include a manual (operator-initiated) routine wherein the controller 138 proceeds to step 450 upon receiving corresponding inputs from an appropriate user interface tool (i.e., "yes" with respect to the query in step 430). In one example of such a defined routine, the controller 138 may be configured to keep moving forward and with material on the blade 142 for a predetermined time period (e.g., one minute) or until manually disengaged by input from the operator.

In additional or alternative embodiments, the secondary calibration may include a fully automated routine that checks for certain conditions to determine that there is material on the blade 142 and that the crawler is moving (step 440). Upon satisfying one or more of steps 430 and 440, the secondary calibration can accordingly proceed in step 450. In one example of step 440, the controller 138 may ascertain movement of the crawler 100 and simultaneous engagement of the ground surface by the blade 142 via monitoring of conventional machine operating parameters, such as rimpull and/or track speed values. As used herein, "rimpull" means the tractive force exerted by the vehicle on the ground, measured changes in which may be reliably indicative of material on the blade 142 during movement. Conventional torque sensors are for example known in the art for detecting or estimating the rimpull or torque level associated with one or more ground engaging units 116, 118 of the work vehicle 100.

In an embodiment (not shown), the work vehicle chassis 140 and the blade 142 may be positioned such that the blade 142 engages a known, prepared slope, wherein the controller 138 adjusts the calibration during a manually initiated calibration operation until the measured blade slope matches the known slope. Performing such a routine statically could pose a repeatability challenge due to the presence of only one data point. Accordingly, a more robust solution may be to take multiple points, travel a short distance (e.g., ten feet) between each point, and average the results, or to perform the same steps continuously while travelling very slowly.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of operating a self-propelled work vehicle comprising a chassis and an implement comprising a blade front-mounted thereto for working a ground surface, the method comprising:

receiving signals from a first sensor corresponding to at least a slope of the blade, and receiving signals from a second sensor corresponding to at least a slope of the chassis;

during a first operating mode, controlling a position of the blade relative to the chassis, based at least on a stored calibration value and a detected difference between the slope of the blade and a target slope of the ground surface;

determining a difference between the slope of the chassis and the target slope of the ground surface; and during a second operating mode, controlling the position of the blade relative to the chassis until the slope of the chassis corresponds to the target slope of the ground surface; and altering the stored calibration value based on adjustments to the position of the blade during the second operating mode.

2. The method of claim 1, wherein the second operating mode is manually initiated via a user interface and implemented over a predetermined time and/or distance.

3. The method of claim 2, wherein the second operating mode is implemented with respect to an area with a ground surface having a predetermined slope.

4. The method of claim 1, wherein the second operating mode is automatically implemented and/or maintained based on:

the determined difference between the slope of the chassis and the target slope of the ground surface; and determining that one or more predetermined conditions are satisfied.

5. The method of claim 4, wherein the one or more predetermined conditions comprise determining that the blade is engaging the ground surface.

6. The method of claim 5, comprising determining that the blade is engaging the ground surface at least in part via a detected rimpull value.

7. The method of claim 4, wherein the one or more predetermined conditions comprise detecting forward movement of the chassis.

8. The method of claim 4, wherein the one or more predetermined conditions comprise detecting that a current location of the chassis corresponds to a location previously engaged by the blade.

9. The method of claim 7, comprising detecting a distance traveled by the chassis relative to an engagement of the ground surface by the blade.

10. The method of claim 1, further comprising generating an output signal for displaying one or more of: the difference between the slope of the chassis and the target slope of the ground surface; and an alert that the difference between the slope of the chassis and the target slope of the ground surface exceeds a predetermined threshold.

11. A self-propelled work vehicle comprising:

a chassis;

a work implement comprising a blade mounted to the chassis for working a ground surface;

a first sensor configured to generate one or more signals corresponding to at least a slope of the blade;

a data storage medium having stored thereon at least a calibration value for the one or more signals corresponding to the at least slope of the blade;

a second sensor configured to generate one or more signals corresponding to at least a slope of the chassis; and a controller communicatively linked to the first sensor and the second sensor, and configured to:

during a first operating mode, control a position of the blade relative to the chassis, based at least on the stored calibration value and a detected difference between the slope of the blade and a target slope of the ground surface, and determine a difference between the slope of the chassis and the target slope of the ground surface; and during a second operating mode, control the position of the blade relative to the chassis until the slope of the chassis corresponds to the target slope of the ground surface, and alter the stored calibration value based on adjustments to the position of the blade during the second operating mode.

12. The self-propelled work vehicle of claim 11, wherein the second operating mode is manually initiated via a user interface and implemented over a predetermined time and/or distance.

13. The self-propelled work vehicle of claim 12, wherein the second operating mode is implemented with respect to an area with a ground surface having a predetermined slope.

14. The self-propelled work vehicle of claim 11, wherein the second operating mode is automatically implemented and/or maintained based on:

the determined difference between the slope of the chassis and the target slope of the ground surface; and determining that one or more predetermined conditions are satisfied.

15. The self-propelled work vehicle of claim 14, wherein the one or more predetermined conditions comprise determining that the blade is engaging the ground surface.

16. The self-propelled work vehicle of claim 15, wherein the controller is configured to determine that the blade is engaging the ground surface at least in part via a detected rimpull value.

17. The self-propelled work vehicle of claim 14, wherein the one or more predetermined conditions comprise detecting forward movement of the chassis.

18. The self-propelled work vehicle of claim 14, wherein the one or more predetermined conditions comprise detecting that a current location of the chassis corresponds to a location previously engaged by the blade.

19. The self-propelled work vehicle of claim 17, wherein the controller is configured to detect a distance traveled by the chassis relative to an engagement of the ground surface by the blade.

20. The self-propelled work vehicle of claim 11, wherein the controller is configured to generate to a user interface an output signal for displaying one or more of: the difference between the slope of the chassis and the target slope of the ground surface; and an alert that the difference between the slope of the chassis and the target slope of the ground surface exceeds a predetermined threshold.

* * * * *